United States Patent [19]

McMorries, IV et al.

[11] Patent Number: 5,004,042

[45] Date of Patent: Apr. 2, 1991

[54] CLOSED LOOP COOLING FOR A MARINE ENGINE

[75] Inventors: Lee W. McMorries, IV; James B. Saatkamp, both of Stillwater, Okla.

[73] Assignee: Brunswick Corporation, Skokie, Ill.

[21] Appl. No.: 415,566

[22] Filed: Oct. 2, 1989

[51] Int. Cl.[5] ..... B63H 21/10; B63H 21/38; F28F 9/06; F28F 21/06

[52] U.S. Cl. ..... 165/41; 165/51; 165/76; 165/158; 165/159; 165/905; 123/41.01; 440/88

[58] Field of Search ..... 165/41, 51, 159, 905, 165/159, 76, 82, 158; 123/41.01; 440/88

[56] References Cited

U.S. PATENT DOCUMENTS

| | | | |
|---|---|---|---|
| 1,567,814 | 12/1925 | Peebles | 165/158 |
| 1,831,971 | 11/1931 | Sandstrom | 165/158 |
| 2,196,683 | 4/1940 | Pickstone | 165/82 |
| 2,466,525 | 4/1949 | Wilson | 165/11.1 |
| 2,670,933 | 3/1954 | Bay | 165/41 |
| 2,811,337 | 10/1957 | Andersen | 165/159 |
| 3,301,321 | 1/1967 | Poore | 165/82 |
| 3,489,209 | 1/1970 | Johnson | 165/905 |
| 3,572,429 | 3/1971 | Myers | 165/158 |
| 3,804,161 | 4/1974 | Nowak | 165/158 |
| 4,105,065 | 8/1978 | Chinco | 165/158 |
| 4,190,101 | 2/1980 | Hartmann | 165/905 |
| 4,589,478 | 8/1987 | Ap | 165/51 |
| 4,685,430 | 5/1986 | Wunder | 165/76 |

FOREIGN PATENT DOCUMENTS

| | | | |
|---|---|---|---|
| 0120497 | 3/1984 | European Pat. Off. | 165/70 |
| 0162599 | 12/1980 | Japan | 165/905 |
| 0052197 | 3/1984 | Japan | 165/159 |
| 0008697 | 1/1985 | Japan | 165/159 |
| 7902727 | 10/1980 | Netherlands | 123/41.01 |
| 8605578 | 9/1986 | World Int. Prop. O. | 165/163 |

*Primary Examiner*—John Ford

*Attorney, Agent, or Firm*—Laney, Dougherty, Hessin & Beavers

[57] ABSTRACT

A marine power system having closed loop cooling includes a marine engine having a cooling fluid passage defined therethrough through which a cooling fluid stream may pass. A shell and tube heat exchanger has a tube side flow path and a shell side flow path defined therein. Cooling fluid conduits connect the cooling fluid passage from the marine engine to the tube side flow path so that the cooling fluid stream from the engine is directed through the tube side flow path of the heat exchanger. A raw water supply system directs a raw water stream from a body of water through the shell side flow path and then back to the body of water. The heat exchanger includes an outer housing and a tube bundle receiver in the outer housing. The outer housing is comprised of a shell and first and second end caps. The tube bundle includes a plurality of straight parallel tubes held between two spaced bundle bases. The housing and the bundle bases are constructed of non-metallic corrosion resistant materials. The tubes are constructed of metallic materials suitable for efficient heat transfer. The tubes are arranged in N substantially similar groups, each group being located in one of N cross-sectional areas subtending an angle of substantially 360°/N about a central longitudinal axis of the bundle. N is an integer of at least 3.

13 Claims, 6 Drawing Sheets

CLOSED LOOP COOLING FOR A MARINE ENGINE

BACKGROUND OF THE INVENTION

1. Field of the Invention

The present invention relates generally to heat exchangers, and more particularly, but not by way of limitation, to a heat exchanger for use in a closed loop cooling system for a marine engine.

2. Description of the Prior Art

Many marine engines, particularly those designed for use in salt water, utilize closed loop cooling systems. In a closed loop cooling system, a cooling fluid stream circulates through the engine and also through the shell side of a shell and tube heat exchanger. Raw water from an ocean or lake is pumped in a raw water stream through the tube side of the heat exchanger, so that excess heat from the marine engine is transferred from the closed loop cooling fluid stream to the raw water stream in the heat exchanger. The raw water stream then returns the excess heat to the ocean or lake. Thus, raw water, especially salt water, never passes through the cooling fluid passages of the engine. Also, antifreeze and other such coolant fluids can be used in the closed loop cooling fluid stream.

Such heat exchangers for use in closed loop cooling systems of marine engines have in the past been constructed substantially entirely of copper. The outer shell, end plates, and tubes were all copper and were brazed together.

Although copper heat exchangers such as that just described have been successfully utilized in closed loop cooling systems for marine engines by the assignee of the present invention and by others for many years, there are several disadvantages inherent in this prior design.

The heat exchangers constructed from copper are relatively expensive due to the cost of materials and the substantial amount of labor required for construction of the soldered assembly. Additionally, the copper shells are subject to physical damage when being handled prior to installation in a marine vessel. The thin copper shells are relatively easy to dent, and such dented units typically must be scrapped since they are aesthetically unacceptable for sale as a new item. Additionally, heat exchangers constructed of copper are subject to substantial corrosion problems, particularly in salt water. Further, since the tube bundle cannot be readily removed from the shell with a heat exchanger constructed of brazed copper, any leaking tubes must simply be plugged, thus reducing the overall effectiveness of the heat exchanger.

SUMMARY OF THE PRESENT INVENTION

The present invention provides a marine power system having closed loop cooling which includes an improved heat exchanger which eliminates many of the problems discussed above.

One important modification as compared to the prior art exchanger described above, is that the heat exchanger of the present invention directs the cooling fluid stream from the marine engine through the tube side rather than the shell side of the heat exchanger. Accordingly, the raw water stream is circulated through the shell side of the heat exchanger of the present invention. This greatly reduces the temperatures which the shell of the heat exchanger must be able to withstand, thus permitting use of thermoplastic materials to construct the shell.

Additionally, a new construction is provided for the internal components of the heat exchanger. A housing of the heat exchanger includes the cylindrical shell and first and second end caps. A generally cylindrical tube bundle is held within the shell between the first and second end caps. At least one of the end caps is readily removable so that the tube bundle can be readily removed from the shell for cleaning and repair.

The tube bundle includes first and second disc shaped bundle bases having a plurality of tube receiving openings disposed therein in a pattern. The bundle bases each have an outer periphery closely received in the shell. The tube bundle includes a plurality of tubes having free ends received in the tube openings of the bundle bases.

When the tube bundle is disposed in the shell of the housing, the bundle bases extend partially outward past first and second ends of the shell.

Each of the end caps includes a blind bore for closely receiving a portion of the outer periphery of one of the bundle bases, and a counterbore for closely receiving a cylindrical outer surface of the shell adjacent one end thereof.

First and second O-ring seals are provided between the end cap and the bundle base and the outer shell, respectively.

The tubes of the tube bundle are arranged in N substantially similar groups, each group being located in one of N cross-sectional areas subtending an angle of substantially 360° /N about a central longitudinal axis of the bundle. N is an integer of at least 3.

A flow divider means of the heat exchanger directs a cooling fluid stream from a cooling fluid inlet of the housing into one end of the tubes of a first one of the groups of tubes, then sequentially through the tubes of each of the other groups and then out a cooling fluid outlet of the housing, so that the cooling fluid stream makes N lengthwise passes through the tube bundle.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 11, the tubes have been assembled with the left bundle base and associated backup plate. In FIG. 12 an adhesive material is being injected into the cavity defined between the bundle base and the backup plate. In FIG. 13 the assembled tube bundle is shown.

In FIG. 15 an alternative design for the bundle base is shown wherein the backup plate snaps into place relative to the bundle base. FIG. 16 illustrates the use of an assembly jig for aligning the tubes with the holes in the backup plate and the bundle base. FIG. 17 shows the tubes having been inserted in place over the tapered guide rods of the assembly jig. FIG. 18 shows the assembled tube bundle with the assembly jig having been removed. In FIGS. 16–18, only three tubes of the tube bundle are shown for clarity of illustration.

DETAILED DESCRIPTION OF THE PREFERRED EMBODIMENTS

Figure 1:
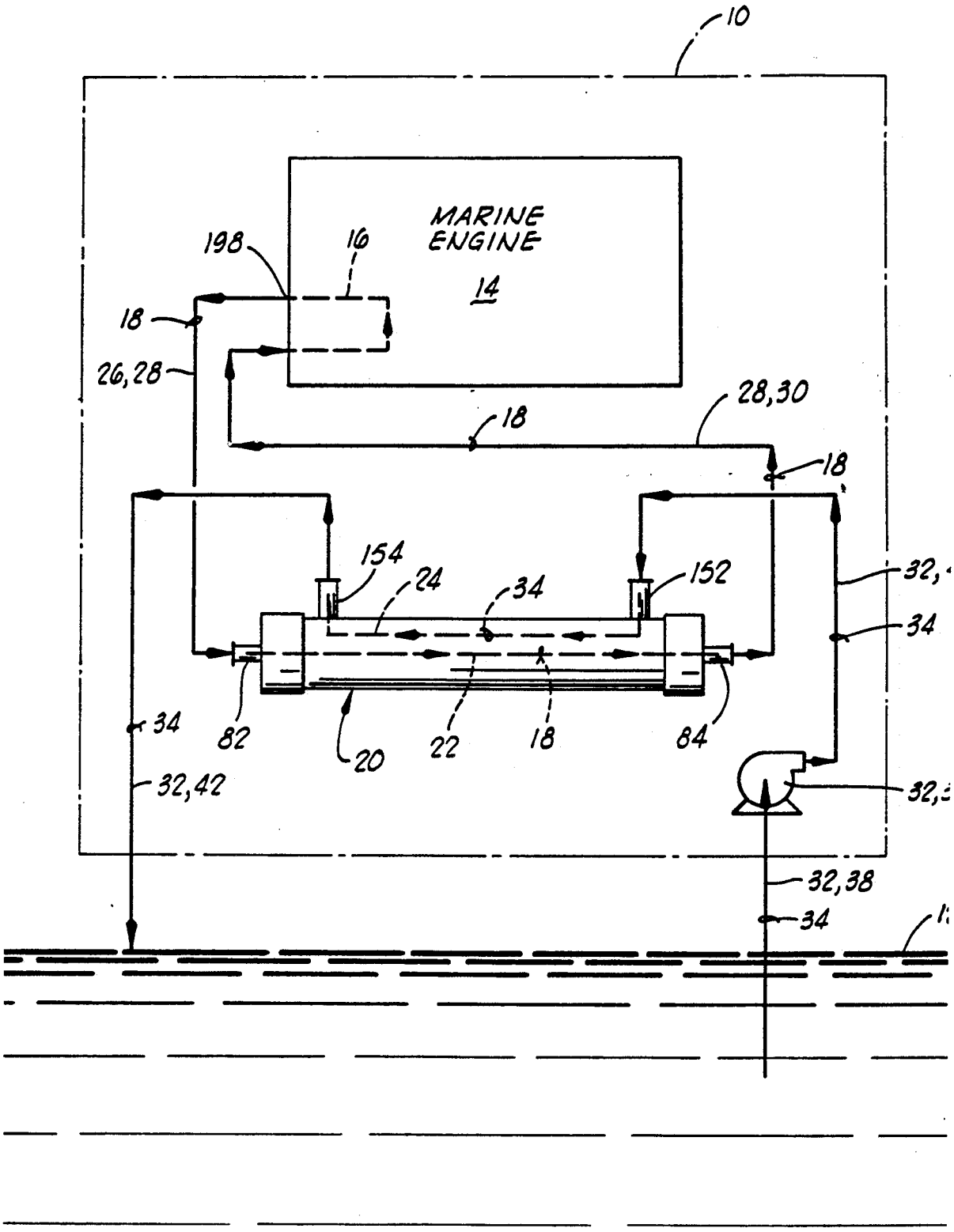
FIG. 1 is a schematic illustration of a marine engine in a marine vessel located on a body of water. A closed loop cooling system is schematically illustrated in association with the marine engine.

Referring now to the drawings, and particularly to FIG. 1, a marine power system is schematically designated within the phantom lines indicated by the numeral 10. The system 10 will typically be installed in a boat floating on a body of water 12. The system 10 includes a marine engine 14 having a cooling fluid passage 16 defined therethrough through which a cooling fluid stream generally denoted by the numeral 18 may pass. The cooling fluid stream 18 will typically be comprised of water and/or coolant fluid such as antifreeze.

The system 10 also includes a shell and tube heat exchanger generally designated by the numeral 20. The heat exchanger 20 has defined therein a tube side flow path 22, and a shell side flow path 24.

The system 10 includes cooling fluid conduit means 26 for connecting the cooling fluid passage 16 to the tube side flow path 22 so that the cooling fluid stream 18 from the engine 14 is directed through the tube side flow path 22 of heat exchanger 20. The conduit means 26 includes a cooling fluid supply conduit 28 and a cooling fluid return conduit The cooling fluid stream 18 is defined and contained within the cooling fluid passage 16, cooling fluid supply conduit 28, tube side flow path 22, and cooling fluid return conduit 30.

The system 10 also includes a raw water supply means generally designated by the numeral 32 for directing a raw water stream 34 from the body of water 12 through the shell side flow path 24 and then back to the body of water 12. Excess heat from the engine 14 is transferred to the cooling fluid stream 18, then from the cooling fluid stream 18 in the tube side flow path 22 to the raw water stream 34 in the shell side flow path 24 and then back to the body of water 12 as the raw water stream 34 returns thereto.

The raw water supply means 32 includes a pump 36, a suction line 38, a raw water supply line 40, and a raw water return line 42.

The raw water stream 34 is contained and defined within suction line 3S, raw water supply line 40, shell side flow path 24, and raw water return line 42. It will be appreciated by those skilled in the art that in a typical boat having for example an inboard/outboard type of drive system, part or all of the suction line 38, raw water supply line 40, and raw water return line 42 will actually be comprised of passages defined in the outdrive system.

Figure 2:
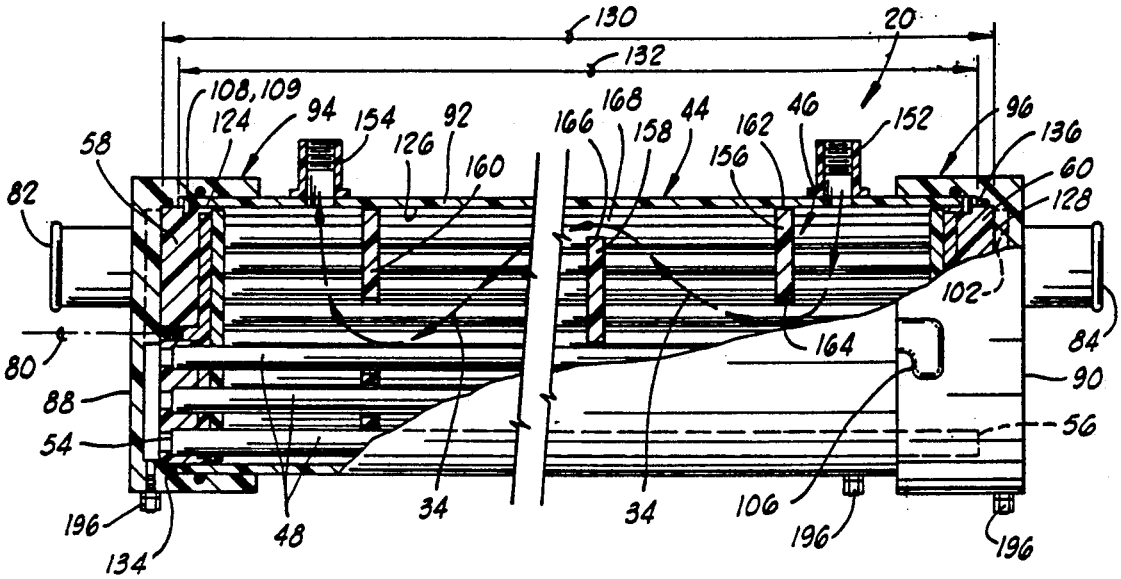
FIG. 2 is a side elevation partly sectioned view of the heat exchanger.

The heat exchanger 20 is best shown in FIG. 2. The heat exchanger 20 includes an outer housing generally designated by the numeral 44 and a generally cylindrical tube bundle 46 received in the housing 44.

The tube bundle 46 includes a plurality of substantially parallel straight tubes such as 48. Each parallel tube includes first and second opposite ends. For example, the lowermost tube 48 which is shown partly in exposed view and partly in dotted lines behind the shell 44 in FIG. 2, has a first end 54 and a second end 56.

Figure 5:
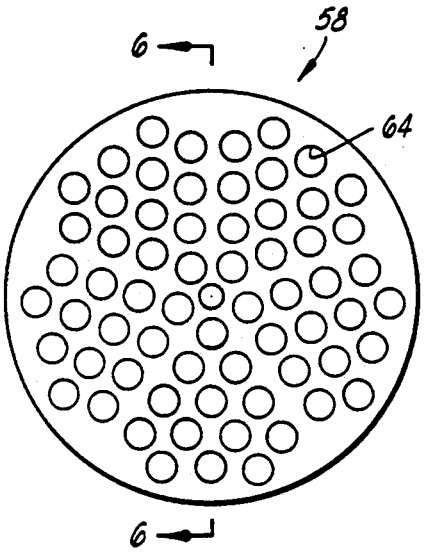
FIG. 5 is a left end elevation view of the leftmost bundle base of the heat exchanger of FIG. 2.
Figure 7:
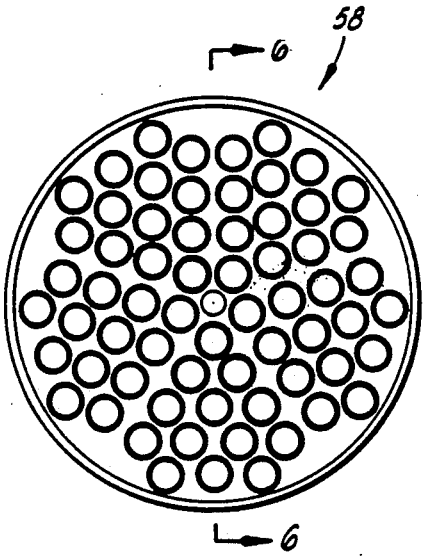
FIG. 7 is a right end elevation view of the bundle base of FIG. 6.
Figure 8:
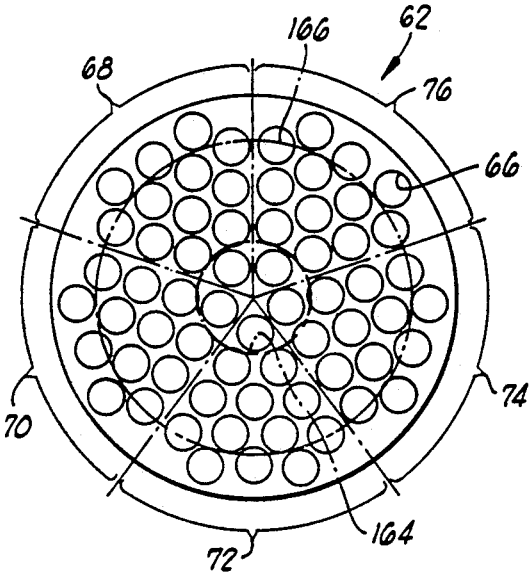
FIG. 8 is a left end elevation view of the backup plate associated with the bundle base of FIG. 5.
Figure 16:
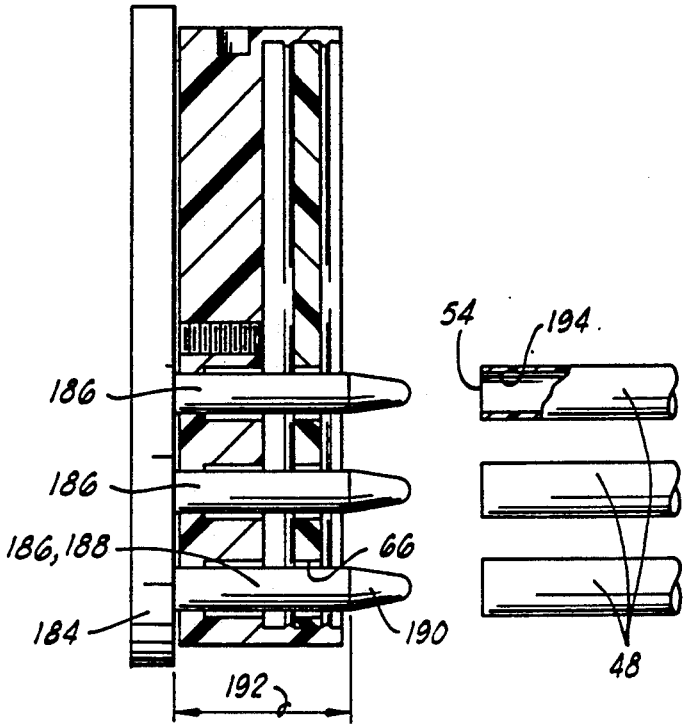

As best seen in FIGS. 5, 7 and 8, there are sixty-five such tubes 48 in the tube bundle 46 illustrated. For simplicity, any and all of these sixty-five tubes will be hereinafter referred to as having a first end 54 and a second end 56. As is best shown in FIG. 16, the ends 54 and 56 are open ends, and the tubes 48 each have a cylindrical bore 194.

Figure 6:
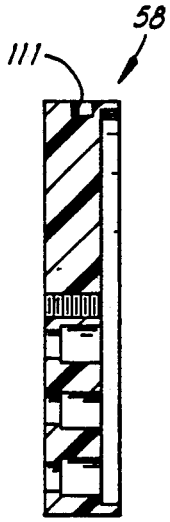
FIG. 6 is an elevation sectioned view of the bundle base of FIG. 5, taken along lines 6—6 of FIGS. 5 and 7.

The tube bundle 46 includes first and second disc shaped bundle bases 58 and 60, which may also be referred to as tube bases 58 and 60. The bundle bases 58 and 60 are identical in construction. First bundle base 58 is illustrated in FIGS. 5–7.

Figure 9:
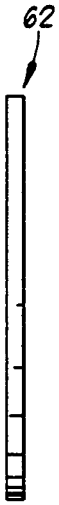
FIG. 9 is a side elevation view of the backup plate of FIG. 8.

Associated with bundle base 58 is a backup plate 62 illustrated in FIGS. 8 and 9. The bundle base 58 has a plurality of tube receiving openings 64 disposed therein in a pattern corresponding to the arrangement of the tubes 48.

The backup plate 62 similarly has a pattern of holes 66 therethrough corresponding to the pattern of tube receiving openings 64 in the tube base 58. The pattern of openings 64 and holes 66 corresponds to the arrangement of the tubes 48 within the tube bundle 46.

As is illustrated in radial phantom lines in FIG. 8, this pattern of holes 66 and the pattern of the corresponding tubes 48 is arranged in five substantially similar groups 68, 70, 72, 74 and 76 divided by imaginary radial lines as have been superimposed on FIG. 8.

Figure 10:
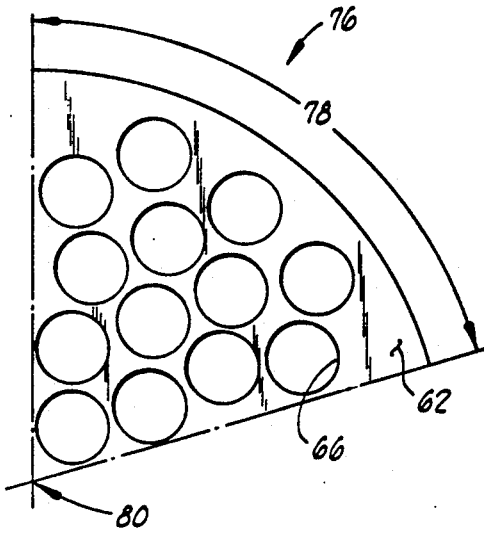
FIG. 10 is an enlarged view of one pie shaped segment of the backup plate of FIG. 8.

As is apparent in FIG. 10, the tubes 48 are somewhat nested together within each of the groups 68–76. The actual arrangement of the tubes 48 is best illustrated in FIG. 10 rather than in the smaller scale view of FIGS. 5, 7 or 8. This nesting of the tubes within the pie shaped segments of the tube bundle permits a greater number of tubes to be placed within a given diameter tube bundle than is possible when the tubes are arranged in horizontal layers as was typically the case in the prior art.

The groups 68–76 are each located in one of five cross sectional areas subtending an angle 78 of 72° about a central longitudinal axis 80 of the bundle 46.

Describing this arrangement more generally, the tubes 48 can be said to be arranged in N substantially similar groups, each group being located in one of N cross-sectional areas subtending an angle of substantially 360° /N about the central longitudinal axis 80 of the bundle 46. As is further explained below, N is an integer of at least 3, and N equals 5 in the preferred embodiment illustrated.

Referring again to FIG. 2, the housing 44 has a tube side inlet 82 and a tube side outlet 84 defined therethrough.

A flow divider means 86 (see FIG. 4) is provided for directing the cooling fluid stream 18, which may also be referred to as a tube side fluid stream 18, from the tube side inlet 82 into the first end 54 of the tubes 48 of one of the groups 68–76, then sequentially through the tubes 48 of each of the other ones of the groups 68–76 and then out the tube side outlet 84, so that the tube side fluid stream makes N, or in this case five, lengthwise passes through the tube bundle 46.

It will be appreciated that, when the tube side inlet and outlet 82 and 84 are located adjacent first and second opposite ends S8 and 90 of housing 44, N will be an odd integer.

The housing 44 includes a hollow cylindrical shell 92 and first and second end caps 94 and 96, respectively, attached to the shell 92 and defining the first and second opposite ends, 88 and 90, respectively. The tube side inlet 82 and tube side outlet 84 are disposed through the first and second end caps 94 and 96, respectively. End caps 94 and 96 can be referred to as hot end cap 94 and cold end cap 96 since the hotter cooling fluid enters hot end cap 94 and the cooler cooling fluid exits cold end cap 96.

Figure 4:
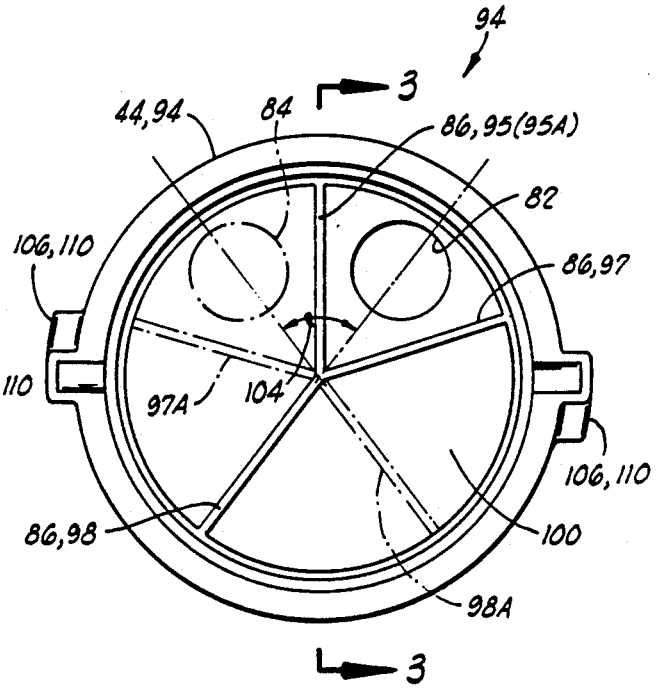
FIG. 4 is a right end elevation view of the end cap of FIG. 3.

The flow divider means 86, as best seen in FIG. 4, includes a plurality of radially extending divider walls 95, 97, and 98 defined on an axially inner surface 100 of first end cap 94 and a similar identical set of divider walls 95A, 97A and 98A defined on an axially inner surface 102 of second end cap 96.

The first and second end caps 94 and 96 are substantially identical in construction. When installed on the heat exchanger 20, the tube side outlet 84 of second end cap 96 is rotationally displaced relative to the tube side inlet 82 of first end cap 94 by an angle of 360° /N, or in the illustrated embodiment 72° , about the central axis 80 of tube bundle 46.

This is best illustrated with reference to FIGS. 2 and 4. If one were to take a right end view of the heat exchanger in FIG. 2, and superimpose the position of the tube side outlet 84 on the first or left end cap 94, the tube side outlet 84 would be positioned as illustrated in phantom lines superimposed on the view of FIG. 4. As is apparent in FIG. 4, the tube side outlet 84 is offset from tube side inlet 82 by an angle 104 of 72° . The relative position of the divider walls of right end cap 96 are also represented by phantom lines 97A and 98A. Its divider wall 95A is superimposed upon divider wall 95 of first end cap 94 and thus is not shown.

The heat exchanger 20 includes a J-slot type connector means 106 for connecting the end caps 94 and 96 to the shell 92 and for automatically defining the relative rotational positions of the end caps 94 and 96 relative to each other and to the shell 92 as previously described with regard to FIG. 4.

Heat exchanger 20 also includes a key means 108 for holding the tube bundle 46 in a desired rotational position relative to the shell 92 and to the end caps 94 and 96. Key means 108 includes a cylindrical pin 109 received in a radial blind bore 111 of bundle base 58, and engaging a notch 113 in the left end of shell 92.

Figure 3:
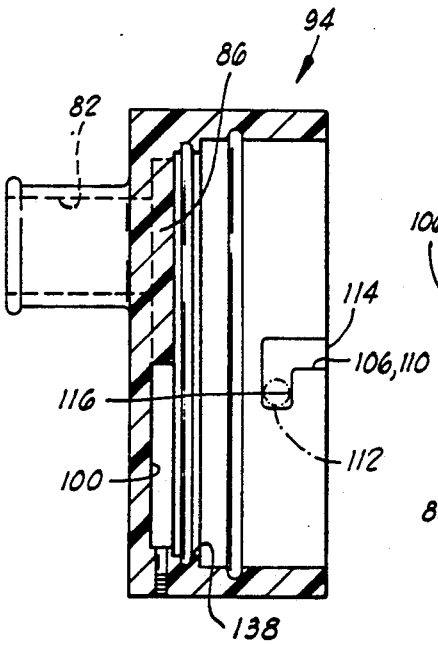
FIG. 3 is an enlarged elevation sectioned view of the left end cap of the heat exchanger of FIG. 2. The section shown in FIG. 3 is taken along line 3—3 of FIG. 4.

The J-slot connector means comprises two J-slots 110 formed on diametrically opposite sides of each of the end caps 94 and 96, and to corresponding lugs 112 (see FIG. 14) extending radially outward from the shell 92. The end caps 94 and 96 are readily assembled with the shell 92 after the tube bundle 46 is in place therein simply by sliding the lugs 112 into open ends 114 (see FIG. 3) of each of the J-shaped slots 110 and then rotating the end caps 94 and 96 slightly so that the lug 112 will be in a final position as illustrated in phantom lines in FIG. 3. Although it is not illustrated as such in the figures, the lateral leg of the J-slot 106 may be slightly relieved at a location approximately designated by the numeral 116 so that there will be a cam type interaction between the lugs 112 and the J-shaped slots 110 with the lugs 112 finally resting in a resiliently locked manner in the position generally designated in FIG. 3.

With the end caps 94 and 96 and the tube bundle 46 oriented in the manner just described, the flow path of the tube side fluid stream 18 can be more specifically described as follows. The tube side fluid stream 18 first enters tube side inlet 82 and is directed between divider walls 95 and 97 into the first end 54 of first group 68 of tubes 48 and passes from left to right as seen in FIG. 2 along the length of those tubes.

As the tube side fluid stream exits the second end 56 of that first group 68 of tubes, it is contained between divider walls 95A and 98A of second end cap 96 and caused to enter the second ends 56 of the second group 70 of tubes 48, and then to pass from right to left as seen in FIG. 2.

The tube side fluid stream 18 then exits the first end 54 of the tubes of the second group 70 between divider walls 97 and 98 of first end cap 94 and is thus caused to reverse its direction and enter the first ends 54 of the third group 72 of tubes 48 and to pass from left to right as seen in FIG. 2 through that third group of tubes 72.

Upon exiting the second ends 56 of the third group of tubes 72, the tube side fluid stream 18 is located between divider walls 97A and 98A of second end cap 96 and thus reverses its direction and enters the second ends 56 of the fourth group of tubes 74 and passes from right to left as seen in FIG. 2.

Finally, the tube side fluid stream 18 exits the first ends 54 of the fourth group 74 of tubes 48 between divider walls 95 and 98 of first end cap 94 and thus reverses its direction entering the first ends 54 of the last group 76 of tubes and passes from left to right where the divider walls 95A and 97A of second end cap 96 direct the fluid out the tube side outlet 84.

There is not necessarily a fluid tight seal between the divider walls 95, 97 and 98 and the bundle base 58. There will be a small amount of fluid leakage past those divider walls, but that is not significant. Most of the tube side fluid stream will make five lengthwise passes through the tube bundle 46 as described.

It will be apparent that due to the manner in which the end caps 94 and 96 are connected to the shell 92 by the J-slot connector means 106, those end caps 94 and 96 are readily removable from shell 92 so that the tube bundle 46 itself is readily removable from the shell 42 after removal of one of the end caps so that the tube bundle 46 can be cleaned or repaired.

Figure 13:
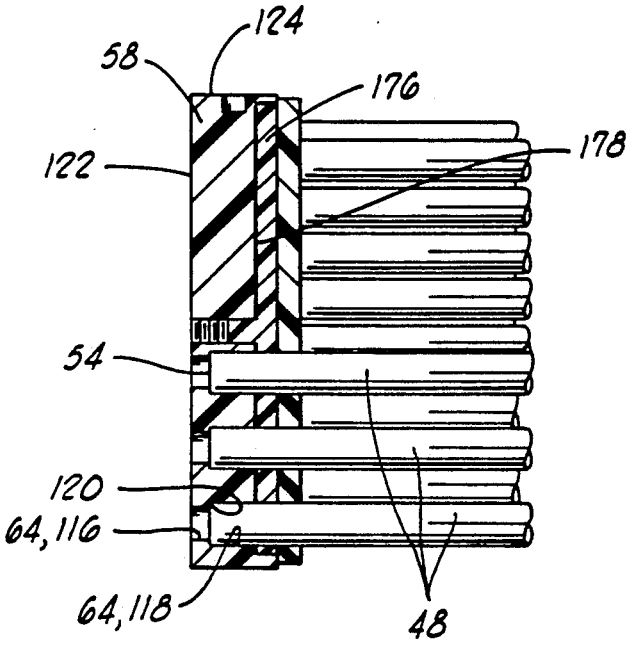

As best seen in FIG. 13, each of the tube receiving openings 64 of bundle base 58 includes a bore 116, and a counterbore 118 defining an annular shoulder 120 therebetween. The ends 54 of tubes 48 are closely received within the counterbores 118 of tube receiving openings 64 and abut shoulders 120. In a preferred embodiment of the invention, the counterbore 118 has a diameter approximately 0.005 inches greater than the outside diameter of the tubes 48. The open ends 54 of tubes 48 communicate with the bore 116 of tube receiving opening 64 and thus with an axially outer face 122 of the bundle base 58.

Bundle base 58 has an outer periphery 124 closely received within a cylindrical inner cavity 126 of shell 92. As seen in FIG. 2, axially outer planar surfaces 122 and 128 of bundle bases 58 and 60 are spaced a distance 130 greater than a length 132 of shell 92 so that the disc shaped bundle bases 58 and 60 extend partially axially outward past first and second ends 134 and 136 of shell 92.

Figure 14:
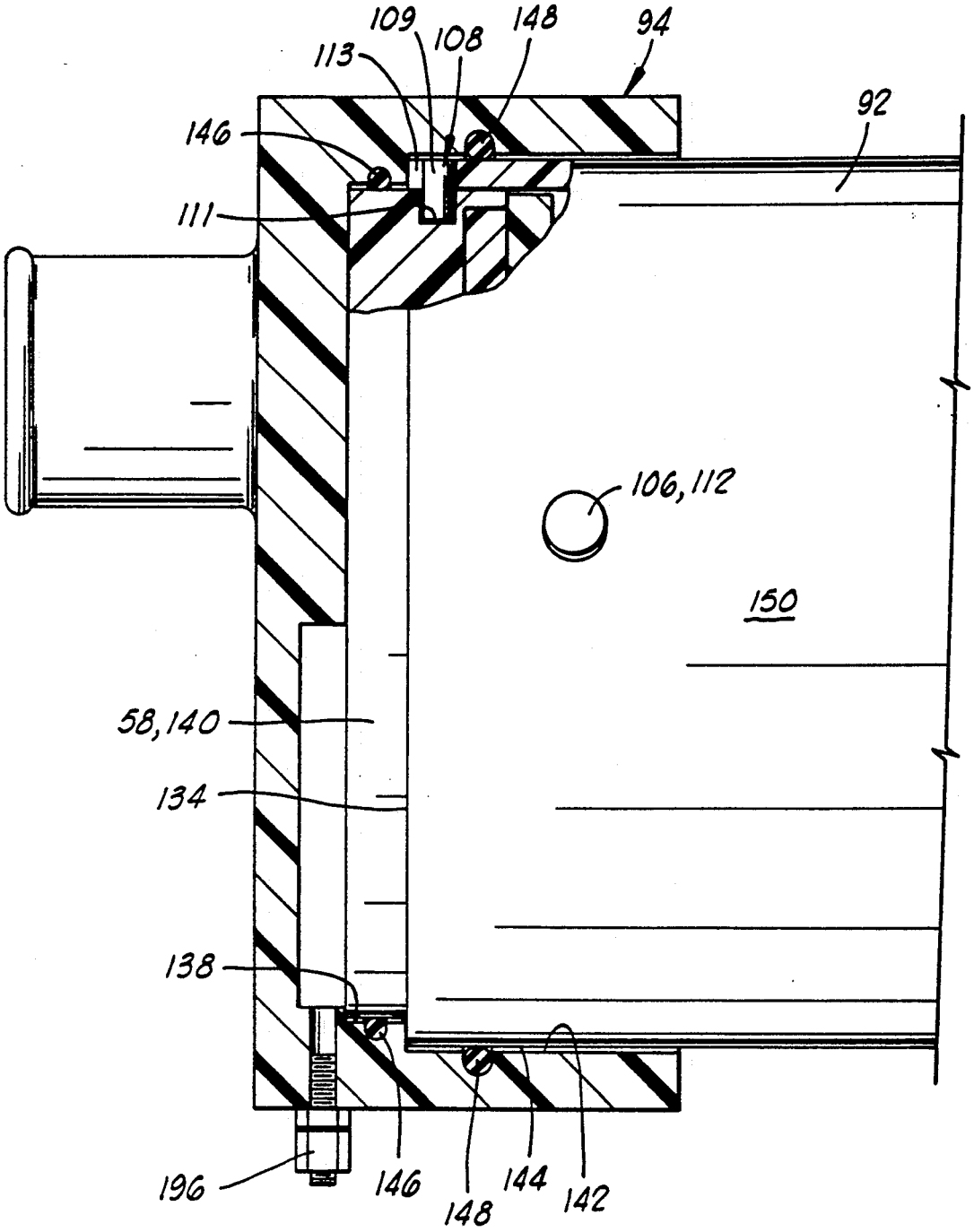
FIG. 14 is an enlarged partly sectioned and partly cut away view of the left end of the heat exchanger of FIG. 2.

The end cap 94 includes a blind bore 138 for closely receiving a portion 140 of bundle base 58 as best illustrated in FIG. 14.

End cap 94 also includes a counterbore 142 for closely receiving a cylindrical outer surface 144 of shell 92 adjacent the first end 134 of shell 92.

A first O-ring seal means 146 is disposed between end cap 94 and bundle base 58 for isolating the tube side fluid stream 18 from the shell side fluid stream 34.

A second O-ring seal means 148 is disposed between end cap 94 and the shell 92 for isolating the shell side fluid stream 34 from an exterior 150 of shell 92.

As mentioned, the housing 44 includes shell 92 and end caps 94 and 96 having shell side or housing side inlets and outlets 82 and 84 disposed therein.

Housing 44 also includes a housing side or shell side inlet 152 and a housing side or shell side outlet 154 for directing the shell side fluid stream 34 through the housing 44. The shell side fluid stream 44 flows through the shell side flow path 24 which is defined between and contacts the interior surface 126 of shell 92 and the outer surfaces of the tubes 48.

The flow path of the shell side fluid stream 34 within the housing 44 between inlet 152 and outlet 154 is controlled by a plurality of longitudinally spaced housing side or shell side flow diverters such as 156, 158, and 160.

The first flow diverter 156 downstream of housing side inlet 152 is annular in shape and has an outer perimeter 162 relatively closely received within shell 92 and has a central opening 164 defined therethrough.

The second flow diverter 166 is located immediately downstream of first flow diverter 162 and is disc shaped having an outer perimeter 166 of diameter substantially less than a diameter of outer perimeter 162 of first flow diverter 156, so that an annular space 168 is defined between outer perimeter 166 of second flow diverter 158 and the inner surface 126 of shell 92.

Third flow diverter 160 is constructed similarly to first flow diverter 156.

The flow diverters 156, 158 and 160 are preferably constructed by injection molding using the same mold as used for the backup plate 62 of FIG. 8, with inserts being used to block portions of the mold. Thus, the central opening 164 of first flow diverter 156 is represented in phantom lines in FIG. 8, and the outer perimeter 166 of second flow diverter 158 is also indicated in phantom lines on FIG. 8.

With this arrangement of flow diverters, the housing side fluid stream 34 flows from the housing side inlet 152 generally radially inward as shown by the arrows 34 in FIG. 2, then through the central opening 164 of first flow diverter 156, then generally radially outward, then through the annular space 168, and so forth, until it finally passes through the central opening of the last flow diverter 160 and flows generally radially outward to housing outlet 154.

It will be appreciated that any desired number of flow diverters can be utilized in the pattern generally shown in FIG. 2.

The housing 44 includes a plurality of drain plugs 196, one of which is located in each of the end caps 94 and 96, and one of which is located in the shell 92.

One advantage of the flow arrangement provided by the heat exchanger 20, wherein the cooling fluid stream 18 from the marine engine 14 passes through the tube side rather than the shell side of the heat exchanger, is that the shell 92 is exposed to the lower temperature of the raw water stream 34, rather than the higher temperatures of the cooling water stream 18.

This permits the shell 92 to be constructed from non-metallic corrosion resistant materials such as various thermoplastics. Preferred materials for the shell 92 include polyvinylchloride and polypropylene. Such polymeric plastic materials for shell 92 can be utilized which are dimensionally stable for the maximum temperature of the raw water stream 34, but which would be dimensionally unstable at the maximum temperatures of the cooling fluid stream 18. These materials could not be utilized for shell 92 if the cooling fluid stream 18 were passed through the shell side of the exchanger as was the case with prior art heat exchangers.

Polyvinylchloride (PVC) is for example dimensionally stable up to about 145° F. Hot water PVC is dimensionally stable to about 180° F. Polypropylene is stable to about 120° C. (248° F.). These materials are all relatively inexpensive and can be obtained with desired colors molded therein. They will not dent and for any given application the least costly material can be chosen which is dimensionally stable at the temperatures expected to be encountered in a given application.

The temperature of the cooling fluid stream 18 at exit point 198 from the marine engine 14 is typically in a range of from about 210–220° F. Approximately that same temperature is maintained when the cooling fluid stream enters the tube side fluid inlet 82. The raw water stream 34 is initially of course at the temperature of the water contained in the body of water 12, which may range from about 33° to about 90° F. The raw water stream is heated as it passes through the heat exchanger 20.

Due to corrosion problems with heat exchangers utilized in marine cooling systems, it would be desirable to make them entirely from non-metallic materials. The tubes 48 themselves, however, necessarily must be made from a metallic material which is suitable for efficient heat transfer, and the most commonly used material for the tubes 48 is copper. The heat exchanger 20 is preferably constructed with the tubes 48 made of copper, and with all other components made of non-metallic corrosion resistant materials. Thus, the end caps 94 and 96, the bundle bases 58 and 60, the backup plates 62 and flow diverters 156, 158 and 160 are all preferably constructed of non-metallic corrosion resistant materials. It has been determined that one suitable material for these components is glass filled nylon.

When assembling metallic tubes 48 with the non-metallic components just described, one of the most difficult problems encountered is that of providing a substantially leak-free bond between the metallic tubes 48 and the nonmetallic bundle bases 58 and 60.

MANNER OF ASSEMBLY OF TUBE BUNDLES

A preferred method of manufacturing the tube bundle 46 can be generally described as follows. First and second bundle bases 58 and 60 are provided each having a plurality of tube receiving openings 64 disposed therein. The bundles bases 58 and 60 are constructed from a non-metallic material such as the previously mentioned glass filled nylon.

This method is best described with reference to FIGS. 11–13 which comprise a sequential series of illustrations of the manner of assembly of the bundle base 58 with the first ends 54 of tubes 48.

The non-metallic bundle base 58 must be provided, having the tube receiving openings 64 defined therein.

Also, a plurality of metallic tubes 48, preferably copper tubes, are provided each having first and second opposite free ends 54 and 56 sized so as to fit within the counterbores 118 of the tube receiving openings 64.

The free ends 54 of the tubes 48 are inserted into the counterbores 118 of the tube receiving openings 64 of the bundle base 58.

A substantially enclosed cavity 170 is defined surrounding the circumferential outer surfaces of the tubes 48 adjacent the bundle base 58. Cavity 170 is defined by placing the backup plate 62 adjacent the bundle base 58 so that cavity 170 is defined therebetween.

The tubes 48 are inserted through the holes 66 of backup plate 62 and into openings 64. The counterbores 118 of tube receiving openings 64 are sized so that the tubes 48 are relatively tightly received within the tube receiving openings 64.

Figure 11:
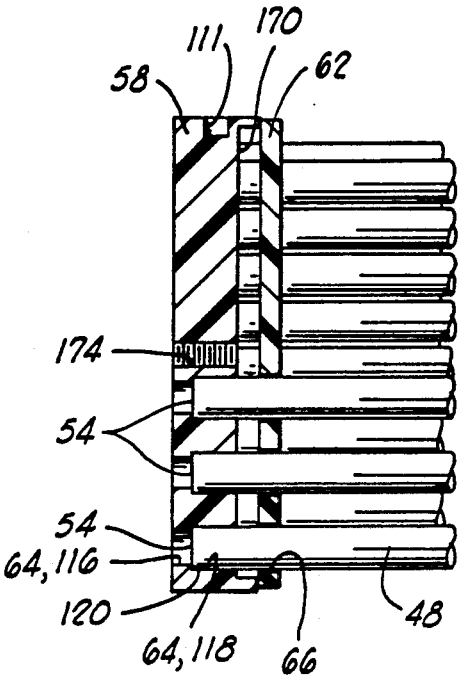
FIGS. 11–13 comprise a sequential series of views of the manner of construction of the left end of the tube bundle of the heat exchanger of FIG. 2.
Figure 12:
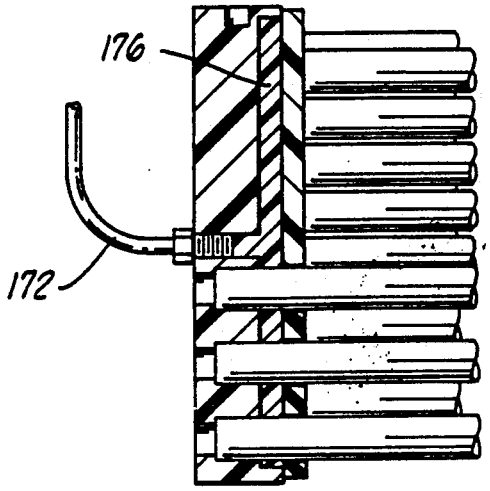

After the tubes 48, bundle base 58 and backup plate 62 have been assembled as shown in FIG. 11, a source 172 of a fluid adhesive material is communicated with the cavity 170 through a threaded central bore 174 in bundle base 58. Then, the cavity 170 is filled with a fluid adhesive material 176 as seen in FIG. 12. When the fluid adhesive material 176 cures and sets, it forms a substantially leakfree bond between the metallic tubes 48 and the non-metallic bundle base 58.

Since the ends of tubes 48 are tightly received in the counterbores 118 of tube receiving openings 64, this prevents any substantial flow of the fluid adhesive material 176 into the tube receiving openings 64 as the cavity 170 is being filled with the fluid adhesive 176.

The holes 66 in backup plate 62, on the other hand, are large enough that there are sufficient clearances between the tubes 48 and the holes 66 to permit air and excess fluid adhesive 176 to vent through those clearances during the filling of cavity 170. Additionally, with the embodiment shown in FIGS. 11–13, there typically will not be a fluid tight seal between bundle base 58 and backup plate 62, and thus some air and fluid adhesive material may also vent between bundle base 58 and backup plate 62 around the periphery thereof. This venting of fluid adhesive material 176 provides a positive indication that the cavity 170 is completely filled with the fluid adhesive.

Typical dimensions of the tubes 48 and the openings in which they are received are 0.375 inches outside diameter for the tubes 48, 0.380 inches inside diameter for the counterbore 118 of tube receiving opening 64, and 0.395 inches inside diameter for the holes 66.

Typically no clamping device or the like is necessary to hold the backup plate 62 in place adjacent bundle base 58. In spite of the fact that there is some clearance between the holes 66 and the tubes 48, it will be appreciated that when the backup plate 62 is in place around the sixty-five tubes 48, which will not be perfectly aligned, the backup plate 62 will be physically contacting most if not all of the tubes 48 at some point, and will be relatively difficult to slide along the length of the tubes 48. Thus, once the backup plate 62 and tube base 58 are placed adjacent each other with the tubes 48 in place therethrough, they will remain in place during filling of the cavity 170 with the fluid adhesive 176.

The metallic, preferably copper, tubes 48 and the non-metallic materials of the tube bases 58 and 60 have first and second coefficients of thermal expansion, respectively, which are substantially different. For example, the coefficient of thermal expansion of the copper tubes 48 is approximately $50\times10^{-6}$ *in/in/°* C., and the coefficient of expansion of the glass filled nylon bundle base 58 is in the range of 20 to $29\times10^{-6}$ in/in° C.

Since the heat exchanger 20 is subjected to relative large changes in temperature during operation thereof, it is critical that the fluid adhesive 176, after it cures, retains a sufficient elasticity to accommodate dimensional changes of the bundle bases 58 and 60 and tubes 48 due to thermal expansion encountered during the operation of heat exchanger 20. There must be sufficient elasticity of the cured fluid adhesive material 176 to accommodate this expansion without breaking the substantially leak-free bond which the fluid adhesive 176 provides between the tubes 48 and the bundle bases 58 and 60.

Further, it is noted that the fluid adhesive 176 bonds to the outer surfaces of the tubes 48 and to an axially inner end face 178 of tube base 58 to form this leak-free bond. Since there is no substantial incursion of fluid adhesive material 176 into the tube openings 64, there generally is no adhesive bond between the counterbores 118 and the copper tubes 48.

The cured adhesive material 176 as shown in FIG. 13, can generally be described as a matrix 176 of adhesive material surrounding and bonded to the circumferential outer surfaces of the tubes 48 adjacent the bundle base 58 and bonded to the bundle base 58 to provide the substantially leak-free bond between the tubes 48 and the bundle base 58.

Turning now to FIGS. 15–18, an alternative embodiment of the bundle base and backup plate are shown, along with an illustration of a preferred method for assembling the tubes 48 with the bundle base and backup plate.

Figure 15:
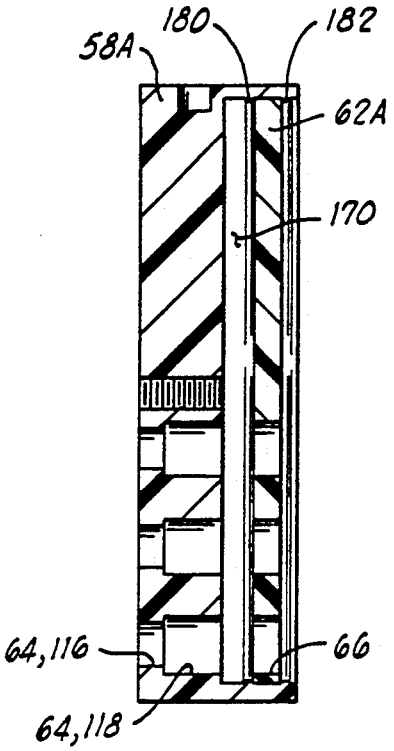
FIGS. 15–18 comprise a sequential series of views showing the manner of assembly of an alternative embodiment of the tube bundle.

In FIG. 15, a modified bundle base 58A and backup plate 62A are illustrated. The backup plate 62A is designed to snap in place within bundle base 58A between annular resilient ridges 180 and 182 so that the bundle base 58A and backup plate 62A can be assembled together prior to the insertion of the tubes 48 therein.

Then the tubes 48 can be substantially simultaneously inserted through the holes 66 of backup plate 62A and the tube receiving opening 64. By ∂substantially simultaneously", it is meant that the tubes 48 are inserted in a single continuous motion first through one and then the other of the holes 66 and tube receiving opening 64.

Figure 17:
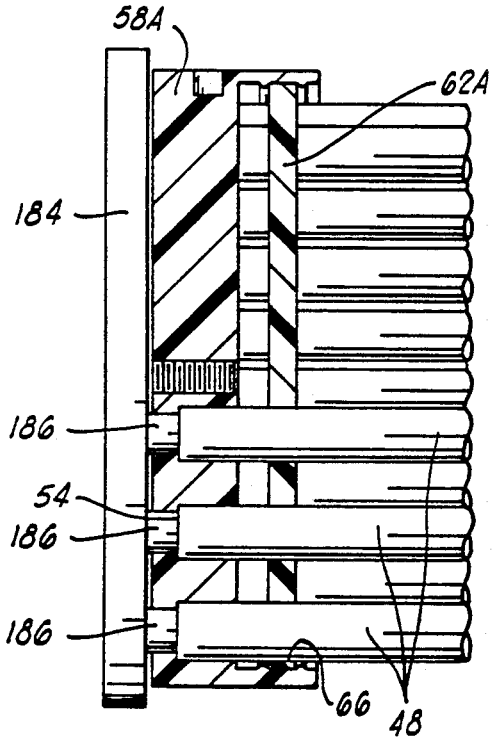

FIGS. 16 and 17 illustrate a preferred manner of inserting the tubes 48 into the previously assembled bundle base 58A and backup plate 62A.

An assembly jig 184 has a plurality of tapered centering rods 186 arranged in a pattern corresponding to the pattern of the tube receiving openings 64 in the bundle base 58A. Each centering rod has a substantially cylindrical portion 188 which is closely received through the bore 116 of tube receiving opening 64 by insertion thereof in a first direction from left to right as viewed in FIG. 16. Each centering rod 186 also includes a tapered outer end portion 190. The cylindrical portions 188 have a length 192 sufficient for the cylindrical portion 188 to extend entirely through the hole 66 in backup plate 62A.

Then, the tapered ends 190 of centering rods 186 are engaged with a bore 194 of a corresponding one of the tubes 48. Then the tubes 48 are inserted over the centering rods 186 and through the hole 66 and into the counterbores 118 of tube receiving openings 64. The movement of the tubes 4S relative to the bundle base 58A is in a second direction opposite the direction in which the centering rods 186 were inserted into the bundle base 58A. The centering rods 186 guide the tubes 48 through the holes 66 and into the counterbores 118 of tube receiving openings 64.

Figure 18:
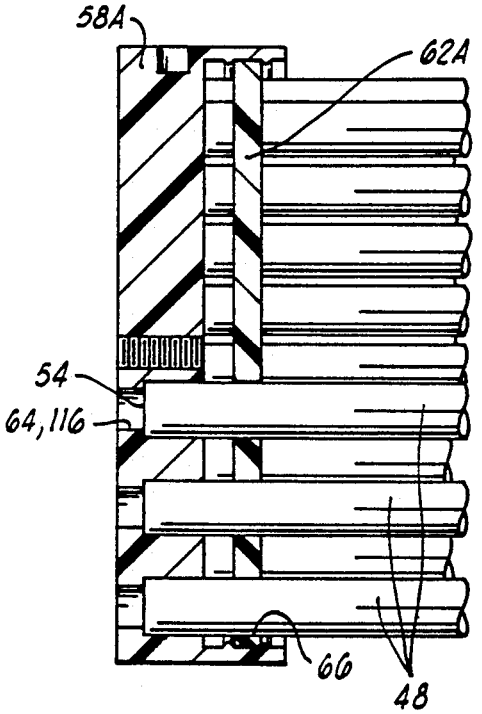

FIG. 17 shows the tubes 48 after they have been inserted into place over the centering rods 186. FIG. 18 shows the assembly after the assembly jig 184 has been removed. The assembly of FIG. 18 is now ready for filling of the cavity 170 with liquid adhesive 176 in a manner similar to that previously described with regards to FIGS. 11–13.

Thus it is seen that the present invention readily achieves the ends and advantages mentioned as well as those inherent therein. While certain preferred embodiments of the invention have been illustrated and described for purposes of the present disclosure, numerous changes in the arrangement and construction of elements thereof may be made by those skilled in the art, which changes are encompassed within the scope and spirit of the present invention as defined by the appended claims.

What is claimed is:

1. A marine power system having closed loop cooling, comprising:

a marine engine having a cooling fluid passage defined therein through which a cooling fluid stream may pass;

a shell and tube heat exchanger having a tube side flow path and a shell side flow path defined therein;

cooling fluid conduit means for connecting said cooling fluid passage to said tube side flow path so that said cooling fluid stream from said engine is directed through said tube side flow path of said heat exchange;

a raw water supply means for directing a raw water stream from a body of water through said shell side flow path and then back to said body of water, so that excess heat from said engine is transferred to said cooling fluid stream, the from said cooling fluid stream in said tube side flow path to said raw water stream in said shell side flow path of said heat exchanger, and then to said body of water as said raw water stream returns thereto;

wherein said heat exchanger includes an outer shell and a bundle of tubes received in said shell, said shell side flow path being defined between and contacting an interior surface of said shell and outer surfaces of said tubes, said outer shell being constructed of a non-metallic corrosion resistant material;

wherein said bundle of tubes includes a plurality of straight parallel tubes held between two spaced bundle bases, said tubes having open ends adjacent each of said bundle bases;

wherein said heat exchanger further includes a hot and a cold end ca connected to first and second ends of said shell, respectively, said hot and cold end caps having a tube side inlet and a tube side outlet, respectively, defined therein;

wherein said tubes are constructed to a metal suitable for efficient heat transfer; and wherein said bundle bases and said end caps are made of non-metallic corrosion resistant materials.

2. The system of claim 1, wherein:

said bundle of tubes is removably received in said shell; and at least one of said end caps is removable from said shell so that said bundle of tubes can be readily removed from said shell for cleaning and repair.

3. The system of claim 1, wherein:

said shell is a cylindrical shell and said tubes each have two open ends, said tubes being arranged in N substantially similar groups, each group being located in one of N cross-sectional areas subtending an angle of substantially 360° /N about a central longitudinal axis of said bundle, wherein N is an odd integer of at least 3.

4. They system of claim 3, wherein:

said heat exchanger includes flow divider means for directing said cooling fluid stream from said tube side inlet into one end of the tubes of a first one of said groups, then sequentially through the tubes of each of the other ones of said groups and then out said tube side outlet, so that said cooling fluid stream makes N lengthwise passes through said tube bundle.

5. The system of claim 4, wherein:

said hot and cold end caps are substantially indentical to each other and are mounted on said shell to face each other with said tube side outlet of said cold end cap being rotationally displaced relative to said tube side inlet of said hot end cap by an angle of 360° /N about said axis of said bundle.

6. The system of claim 5, wherein:

said heat exchanger includes connector means for connecting said end caps to said shell and for automatically defining relative rotational positions of said end caps relative to each other and to said shell; and said heat exchanger also includes key means for holding said tube bundle in a desired rotational position relative to said shell and to said end caps.

7. A marine power system having closed loop cooling, comprising:

a marine engine having a cooling fluid passage defined therein through which a cooling fluid stream may pass;

a shell and tube heat exchanger having a tube side flow path and a shell side flow path defined therein;

cooling fluid conduit means for connecting said cooling fluid passage to said tube side flow path so that said cooling fluid stream from said engine is directed through said tube side flow path of said heat exchanger;

a raw water supply means for directing a raw water stream from a body of water through said shell side flow path and then back to said body of water, so that excess heat from said engine is transferred to said cooling fluid stream, then from said cooling fluid stream in said tube side flow path to said raw water stream in said shell side flow path of said heat exchanger, and then to said body of water as said raw water stream returns thereto;

wherein said heat exchanger includes an outer housing and a generally cylindrical tube bundle received in said housing, said tube bundle including a plurality of substantially parallel tubes each having two opposite open ends;

wherein said housing includes a hollow cylindrical shell and first and second end caps attached to said shell at first and second opposite ends of said shell;

wherein said tube bundle includes first and second disc-shaped bundle bases having a plurality of tube receiving openings disposed therethrough in a pattern corresponding to an arrangement of said tubes, the ends of said tubes being closely received in the tube receiving openings of said bundle bases, said bundle bases each having an outer periphery closely received in a cylindrical inner cavity of said shell, and said bundle bases having axially outer planar surfaces spaced a distance greater than a length of said shell so that said disc-shaped bundle bases extend partially outward past said first and second ends of said shell; and whereine each of said end caps of said housing includes:

a blind bore for closely receiving a portion of the outer periphery of a respective one of said disc-shaped bundle bases;

a counterbore for closely receiving a cylindrical outer surface of said shell adjacent one end of said shell;

first O-ring seal means between said one end cap and said respective one of said bundle bases for isolating said cooling fluid stream from said raw water stream; and second O-ring seal means between said one end cap and said shell for isolating said raw water stream from an exterior of said shell.

8. The system of claim 7, wherein:

said shell, said end caps and said bundle bases are constructed of non-metallic corrosion resistance materials; and said tubes are constructed of copper for efficient heat transfer.

9. A marine power system having closed loop cooling, comprising:

a marine engine having a cooling fluid passage defined therein through which a cooling fluid stream may pass;

a shell and tube heat exchanger including:

an outer housing;

a generally cylindrical tube bundle received in said housing, said tube bundle including a plurality of substantially parallel tubes each having two opposite open ends, said tubes being arranged in N substantially similar groups, each group being located in one of N cross-sectional areas subtending an angle of substantially 360° /N about a central longitudinal axis of said bundle, wherein N is an integer of at least 3;

a tube side fluid inlet and a tube side fluid outlet defined through said housing;

flow divider means for directing a tube side fluid stream from said tube side inlet into one end of the tubes of a first one of said groups, then sequentially through the tubes of each of the other ones of said groups and then out said tube side outlet, so that said tube side fluid stream makes N lengthwise passes through said tube bundle; and a housing side inlet and a housing side outlet for directing a housing side fluid stream in one and only one lengthwise pass through said housing in contact with outer surfaces of said tubes;

cooling fluid conduit means for connecting said cooling fluid passage to said tube side fluid inlet so that said cooling fluid stream from said engine is directed through said tube side flow path of said heat exchanger, said cooling fluid stream being said tube side fluid stream;

a raw water supply means for directing a raw water stream from a body of water to said housing side inlet and then back to said body of water, said raw water stream being said housing side fluid stream, so that excess heat from said engine is transferred to said cooling fluid stream, then from said cooling fluid stream in said tubes to said raw water stream in said housing and then to said body of water as said raw water stream returns thereto;

wherein said housing including a hollow cylindrical shell and first and second end caps attached to said shell at first and second opposite ends of said shell;

wherein said tube bundle includes first and second disc-shaped bundle bases having a plurality of tube receiving openings disposed therein in a pattern corresponding to the arrangement of said tubes, the ends of said tubes being closely received in the tube receiving openings of said bundle bases, said bundle bases each having an outer periphery closely received in a cylindrical inner cavity of said shell, and said bundle bases having axially outer planar surfaces spaced a distance greater than a length of said shell so that said disc-shaped bundle bases extend partially outward past said first and second ends of said shell; and wherein each one of said end caps of said housing includes:

a blind bore for closely receiving a portion of the outer periphery of a respective one of said disc-shaped bundle bases;

a counterbore for closely receiving a cylindrical outer surface of said shell adjacent one end of said shell;

first O-ring seal means between said one end cap and said respective one of said bundle bases for isolating said tube side fluid stream from said housing side fluid stream; and second O-ring seal means between said one end cap and said shell for isolating said housing side fluid stream from an exterior of said shell.

10. The system of claim 9, wherein:

said flow divider means includes a plurality of radially extending divider walls disposed between said end caps and said bundle bases.

11. The system of claim 10, wherein:

said divider walls are defined on axially inner surfaces of said end caps.

12. The system of claim 9, wherein:

said tube side inlet and tube side outlet are disposed through said first and second end caps, respectively.

13. The sytem of claim 12, wherein:

said first and second end caps are substantially identical to each other with said tube side outlet of said second end cap being rotationally displaced relative to said tube side inlet of said first end cap by an angle of 360° /N about said axis of said bundle.

* * * * *

UNITED STATES PATENT AND TRADEMARK OFFICE

CERTIFICATE OF CORRECTION

PATENT NO. : 5,004,042

DATED : April 2, 1991

INVENTOR(S) : Lee W. McMorries, IV and James B. Saatkamp

It is certified that error appears in the above—identified patent and that said Letters Patent is hereby corrected as shown below:

Abstract, line 14, delete "receiver" and insert --received-- therefor.

Column 3, line 53, after "conduit", insert --30.--.

Column 4, line 5, delete "3S" and insert --38-- therefor.

Column 5, line 17, delete "S8" and insert --88-- therefor.

Column 10, line 15, "in/in/°C" should not be superscript.

Column 10, line 17, delete "29x10-6" and insert --$29x10^{-6}$-- therefor.

Column 10, line 57, delete "ϑ" and insert quotation marks therefor.

Column 11, line 13, delete "4S" and insert --48-- therefor.

Column 11, line 53, delete "the" and insert --then-- therefor.

Column 12, line 2, delete "ca" and insert --cap-- therefor.

Column 12, line 6, delete "to" and insert --of-- therefor.

Column 12, line 24, delete "They" and insert --The-- therefor.

Column 12, line 35, delete "indentical" and insert --identical-- therefor.

UNITED STATES PATENT AND TRADEMARK OFFICE

CERTIFICATE OF CORRECTION

PATENT NO. : 5,004,042

DATED : April 2, 1991

INVENTOR(S) : Lee W. McMorries, IV and James B. Saatkamp

It is certified that error appears in the above—identified patent and that said Letters Patent is hereby corrected as shown below:

Column 13, line 24, delete "whereine" and insert --wherein-- therefor.

Column 14, line 21, delete "including" and insert --includes-- therefor.

Signed and Sealed this

Fourth Day of August, 1992

*Attest:*

DOUGLAS B. COMER

*Attesting Officer*

*Acting Commissioner of Patents and Trademarks*